US007261782B2

(12) United States Patent
Hwang et al.

(10) Patent No.: US 7,261,782 B2
(45) **Date of Patent: *Aug. 28, 2007**

(54) TITANIUM ALLOY HAVING HIGH ELASTIC DEFORMATION CAPACITY AND METHOD FOR PRODUCTION THEREOF

(75) Inventors: JungHwan Hwang, Aichi (JP); Tadahiko Furuta, Aichi (JP); Kazuaki Nishino, Aichi (JP); Takashi Saito, Aichi (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 559 days.

This patent is subject to a terminal disclaimer.

(21) Appl. No.: 10/450,530

(22) PCT Filed: Dec. 5, 2001

(86) PCT No.: PCT/JP01/10653

§ 371 (c)(1),
(2), (4) Date: Dec. 8, 2003

(87) PCT Pub. No.: WO02/50324

PCT Pub. Date: Jun. 27, 2002

(65) Prior Publication Data

US 2005/0072496 A1 Apr. 7, 2005

(30) Foreign Application Priority Data

Dec. 20, 2000 (JP) ..... 2000-386949

(51) Int. Cl.
*C22C 14/00* (2006.01)

(52) U.S. Cl. ..... 148/421; 148/670; 148/671; 420/417; 420/418; 420/419; 420/420; 420/421; 420/422

(58) Field of Classification Search ..... None
See application file for complete search history.

(56) References Cited

U.S. PATENT DOCUMENTS

| | | | |
|---|---|---|---|
| 5,545,227 A | 8/1996 | Davidson et al. | |
| 6,607,693 B1 | 8/2003 | Saito et al. | |
| 6,979,375 B2 * | 12/2005 | Furuta et al. | 148/421 |

FOREIGN PATENT DOCUMENTS

| | | |
|---|---|---|
| EP | 0 707 085 | 4/1996 |
| EP | 1 114 876 | 7/2001 |

(Continued)

*Primary Examiner*—John P. Sheehan
(74) *Attorney, Agent, or Firm*—Oblon, Spivak, McClelland, Maier & Neustadt, P.C.

(57) ABSTRACT

A titanium alloy obtained by a cold-working step, in which 10% or more of cold working is applied to a raw titanium alloy, comprising a Va group element and the balance of titanium substantially, and an aging treatment step, in which a cold-worked member, obtained after the cold-working step, is subjected to an aging treatment so that the parameter "P" falls in a range of from 8.0 to 18.5 at a treatment temperature falling in a range of from 150° C. to 600° C.; and characterized in that its tensile elastic limit strength is 950 MPa or more and its elastic deformation capability is 1.6% or more. This titanium alloy is of high elastic deformation capability as well as high tensile elastic limit strength, and can be utilized in a variety of products extensively.

20 Claims, 1 Drawing Sheet

Titanium Alloy of Present Invention

FOREIGN PATENT DOCUMENTS

| | | |
|---|---|---|
| JP | 49-64516 | 6/1974 |
| JP | 52-147511 | 12/1977 |
| JP | 61-157652 | 7/1986 |
| JP | 2-163334 | 6/1990 |
| JP | 5-9630 | 1/1993 |
| JP | 05-009630 | 1/1993 |
| JP | 5-111554 | 5/1993 |
| JP | 5-117791 | 5/1993 |
| JP | 6-73475 | 3/1994 |
| JP | 6-233811 | 8/1994 |
| JP | 6-240390 | 8/1994 |
| JP | 8-299428 | 11/1996 |
| JP | 10-219375 | 8/1998 |
| JP | 2000-102602 | 4/2000 |
| WO | 95/34251 | 12/1995 |
| WO | WO 00/77267 | * 12/2000 |
| WO | WO 01/83838 | * 11/2001 |

* cited by examiner

Conventional Titanium Alloy

Titanium Alloy of Present Invention

TITANIUM ALLOY HAVING HIGH ELASTIC DEFORMATION CAPACITY AND METHOD FOR PRODUCTION THEREOF

TECHNICAL FIELD

The present invention relates to a titanium alloy and a process for producing the same. Specifically, it relates to a titanium alloy, which can be utilized in a variety of products and which is good in terms of the elastic limit strength and elastic deformation capability, and a process for producing the same.

BACKGROUND ART

Since titanium alloy is good in terms of the specific strength, it has been used in the fields of aviation, military, deep-sea survey, and the like. In the filed of automobile as well, titanium alloys have been used in valve retainers, connecting rods and so forth of racing engines. Further, since titanium alloy is good in terms of the anti-corrosiveness as well, it has been often used under corrosive environments. For example, it has been used as materials for chemical plants, oceanic architectures, and so on, and, furthermore, in order to inhibit the corrosion by anti-freezing agents, it has been used for lower front bumpers, lower rear bumpers, and the like. Moreover, aiming at its light-weightness (specific strength) and anti-allergenicity (anti-corrosiveness), titanium alloy has been used for accessories such as wristwatches. Thus, titanium alloys have been used in various and diversified fileds, as for representative titanium alloys, there are, for example, Ti5-Al-2.5Sn ($\alpha$ alloy), Ti-6Al-4V ($\alpha$-$\beta$ alloy), Ti-13V-11Cr-3Al ($\beta$ alloy), and so forth.

By the way, the good specific strength and anti-corrosiveness have been attracting attention, however, its good elasticity has been about to attract attention recently. For example, titanium alloys which are good in terms of the elasticity are about to be used for products adaptable to living bodies (for instance, artificial bones, and the like), accessories (for example, frames of eyeglasses, and so forth), sporting goods (for instance, golf clubs, and so on), springs, and the like. Specifically, when titanium alloy of high elasticity is used for artificial bone, the artificial bone has elasticity close to that of human bone so that it is good in terms of the adaptability to living bodies in addition to the specific strength and anti-corrosiveness.

Further, an eyeglasses frame, comprising highly elastic titanium alloy, fits flexibly to heads, gives no oppressive feelings to wearers, and is good in terms of the shock-absorbing property.

Furthermore, when highly elastic titanium alloy is used for shafts or heads of golf clubs, it is said that flexible shafts or heads of low eigenfrequency can be obtained and that the driving distance of golf ball can be extended.

Moreover, when highly elastic titanium alloy is used for springs, light-weight and large elastic limit springs can be obtained.

Under such circumstances, the present inventors thought of developing a titanium alloy by which the utilization expansion can be further intended in a variety of fields and which is of high elasticity (high elastic deformation capability) and high strength (high tensile elastic limit strength) transcending the conventional levels. Then, the conventional technologies regarding titanium alloys which are good in terms of the elasticity were first surveyed, and consequently the following publications were discovered.

① Japanese Unexamined Patent Publication (KOKAI) No. 10-219,375

In this publication, there is disclosed a titanium alloy which includes Nb and Ta in a summed amount of from 20 to 60%. This titanium alloy is produced by melting a raw material with the composition to cast a button ingot and by carrying out cold rolling, a solution treatment and an aging treatment sequentially to the button ingot, thereby obtaining a low Young's modulus as low as 75 GPa or less. Then, since this titanium alloy exhibits the low Young's modulus, it is believed to be full of elasticity.

However, as can be understood from the examples disclosed in the publication, the tensile strength lowers along with the low Young's modulus. Accordingly, the titanium alloy exhibits a small deformation capability (elastic deformation capability) within the elastic limit, and it does not have such sufficient elasticity that the usage expansion of titanium alloy can be intended.

② Japanese Unexamined Patent Publication (KOKAI) No. 2-163,334

In this publication, there is disclosed "a titanium alloy which comprises Nb: from 10 to 40%, V: from 1 to 10%, Al: from 2 to 8%, Fe, Cr and Mn: 1% or less, respectively, Zr: 3% or less, O: from 0.05 to 0.3%, and the balance of Ti, and which is good in terms of the cold working property."

This titanium alloy is also produced by plasma melting, vacuum arc melting, hot forging and solid-solution treating a raw material making the composition. The publication sets forth that a titanium alloy which is good in terms of the cold working property is thus obtained.

However, in the publication, no specific descriptions are made at all on the elasticity and strength.

③ Japanese Unexamined Patent Publication (KOKAI) No. 8-299,428

In this publication, there is disclosed medical instruments formed of a titanium alloy which comprises from 20 to 40% Nb, from 4.5 to 25% Ta, from 2.5 to 13% Zr and the balance of Ti substantially and whose Young's modulus is 65 GPa or less.

However, since this titanium alloy as well exhibits not only a low Young's modulus but also a low strength, it is not good in terms of the elasticity, either.

④ Japanese Unexamined Patent Publication (KOKAI) No. 6-73,475,

Japanese Unexamined Patent Publication (KOKAI) No. 6-233,811 and

Japanese Unexamined Patent Publication (KOKAI) No. 10-501,719

In these publications, there is disclosed a titanium alloy (Ti-13Nb-13Zr) whose Young's modulus is 75 GPa or less and tensile strength is 700 MPa or more, however, it is insufficient strength-wise to be highly elastic. Note that the claims of the publications set forth Nb: from 35 to 50%, however, no specific examples corresponding thereto are disclosed.

⑤ Japanese Unexamined Patent Publication (KOKAI) No. 61-157,652

In this publication, there is disclosed "a metallic decorative article which contains Ti in an amount of from 40 to 60% and whose balance comprises Nb substantially." The metallic decorative article is produced by arc welding a raw material whose composition is Ti-45Nb, thereafter by casting and forge rolling it, and by cold deep drawing the resulting Nb alloy.

However, in the publication, no descriptions are made at all on specific elasticity and strength.

⑥ Japanese Unexamined Patent Publication (KOKAI) No. 6-240,390

In this publication, there is disclosed "a material for a golf driver head which includes vanadium in an amount of from 10% to less than 25%, whose oxygen content is controlled to 0.25% or less, and whose balance comprises titanium and inevitable impurities."

However, in the publication, no descriptions are made at all on elasticity.

⑦ Japanese Unexamined Patent Publication (KOKAI) No. 5-111,554

In this publication, there is disclosed "a head of a golf club manufactured by a lost wax precision casting method for an Ni—Ti alloy having super elasticity." Then, in the publication, there is a description to the effect that Nb, V and the like can be added slightly.

However, there are no descriptions at all on their specific compositions and elasticity.

⑧ Japanese Unexamined Patent Publication (KOKAI) No. 52-147,511

In this publication, there is disclosed "an anti-corrosive strong niobium alloy which comprises titanium in an amount of from 10 to 85% by weight, carbon in an amount of 0.2% by weight or less, oxygen in an amount of from 0.13 to 0.35% by weight, nitrogen in an amount of 0.1% by weight or less, and the balance of niobium." Moreover, there is disclosed to the effect that, after melt casting the alloy having the composition, by subjecting it to hot forging, cold working and an aging treatment, a niobium alloy which exhibits a much higher strength and is good in terms of the cold-working property can be obtained.

However, in the publication, no descriptions are made at all on specific Young's modulus and elasticity.

DISCLOSURE OF INVENTION

The present invention has been done in view of such circumstances. Namely, it is therefore an object of the present invention to provide a titanium alloy which is full of elasticity transcending the conventional level. Moreover, it is another object thereof to provide a production method which is suitable for producing the titanium alloy.

Hence, the present inventors have been studying earnestly in order to solve this assignment, have been repeated trials and errors, and, as a result, have arrived at developing a titanium alloy, which comprises a Va group element and Ti, and which exhibits a high elastic deformation capability as well as a high tensile elastic limit strength, and a production process for the same.

Namely, a titanium alloy according to the present invention comprises a Va group (vanadium group) element in an amount of from 30 to 60%, and the balance of titanium substantially, when the entirety is taken as 100% (percentage by mass: being the same hereinafter), and obtained by subjecting a cold-worked material to which a work strain is given by a cold-working step to an aging treatment, wherein its tensile elastic limit strength is 950 MPa or more, and its elastic deformation capability is 1.6% or more.

By the combination of Ti and a group Va element, a titanium alloy could be obtained which exhibited a high elastic deformation capability as well as a high tensile elastic limit strength which had not been available conventionally. Then, this titanium alloy can be utilized for a variety of products extensively, and accordingly it is possible to intend their functional improvements and the extension of the degree of freedom in designing them.

Note that the group Va element can be one member of vanadium, niobium and tantalum or a plurality of them. All of these elements are β-phase stabilizing elements, however, it does not necessarily mean that the present titanium alloy is the conventional β alloy.

By the way, the present inventors confirmed that this titanium alloy is provided with a good cold-working property in addition to the good elastic deformation capability and tensile elastic limit strength. However, it has not been cleared yet why this titanium alloy is good in terms of the elastic deformation capability and tensile elastic limit strength. Anyway, from the all-out researches and studies done by the present inventors so far, regarding those properties, it is possible to believe in the following manner.

Namely, as a result of a survey done by the present inventors on one of samples according to the present titanium alloy, it was made clear that, even when this titanium alloy is subjected to cold working, dislocation was hardly introduced thereinto so that it showed a structure whose (110) plane was strongly oriented in a part of directions.

In addition, in a dark field image, using the 111 diffraction point, which was observed with a TEM (Transmission Electron Microscope), the contrast of the image was observed to move together with the inclination of the sample. This suggests that the observed (111) plane was curved, and this was confirmed by a high-magnification lattice-image direct observation as well. Then, the curvature radius of the curve in this (111) plane was extremely small to such an extent that it fell in a range of from 500 to 600 nm.

From these, it is believed to designate that the present titanium alloy has such a nature, which has not been known at all in the conventional metallic materials, that it relieves the influence of working not by the introduction of dislocation but by the curving of crystal plane.

Moreover, the dislocation was observed, in a state in which the 110 diffraction point was strongly excited, in an extremely confined part, however, it was hardly observed when the excitation of the 110 diffraction point was canceled. This shows that the displacement components around the dislocation are remarkably deviated in the <110> direction, and suggests that the present titanium alloy has a very strong elastic anisotropy. Although the reason has not been clear yet, it is believed that this anisotropy closely relates to the revelation, etc., of the high elastic deformation capability, high tensile elastic limit strength and good cold working property of the titanium alloy according to the present invention.

Here, the "tensile elastic limit strength" refers to a stress when a permanent elongation (strain) reaches 0.2% in a tensile test in which loading to a test specimen and unloading therefrom are gradually carried out repeatedly (it will be described in detail later). Moreover, the "elastic deformation capability" means the elongation of the test specimen within the aforementioned tensile elastic limit strength, and a high elastic deformation capability indicates that the elongation is large.

It is more preferred so that this tensile elastic limit strength can be 950 MPa or more, 1,200 MPa or more and 1,400 MPa or more in this order. Moreover, it is more preferred so that the elastic deformation capability can be 1.6% or more, 1.7% or more, 1.8%, 1.9%, 2.0%, 2.1% and 2.2% or more in this order.

Note that when referring to the "strength" simply, it hereinafter indicates either one of the "tensile elastic limit strength" and the "tensile strength" at which test specimens break, or both of them.

The "titanium alloy" set forth in the present invention implies alloys containing Ti, and it does not specify the Ti contents. Therefore, even when components other than Ti (for example, Nb and the like) occupy 50% by mass or more of the entirety of alloys, as far as they are alloys including Ti, they are referred to as "titanium alloys" for convenience in the present specification. Moreover, the "titanium alloy" is one which includes a variety of forms, it is not limited to raw materials (for instance, ingots, slabs, billets, sintered bodies, rolled products, forged products, wire materials, plate materials, rod materials and so forth), but it includes even titanium alloy members (for example, intermediately-processed products, final products, parts of them and so on) which are formed by processing them (being the same hereinafter).

Production Process of Titanium Alloy

The above-described titanium alloy with a high elastic deformation capability and high tensile elastic limit strength can be obtained, for example, by a production process according to the present invention hereinafter described.

① Namely, a process for producing a titanium alloy according to the present invention is characterized in that it comprises: a cold-working step, in which cold working of 10% or more is applied to a raw titanium alloy, comprising a Va group element in an amount of from 30 to 60% and the balance of titanium substantially when the entirety is taken as 100%; and an aging treatment step, in which a cold-worked member, obtained after the cold-working step, is subjected to an aging treatment so that the parameter "P" (the Larson-Miller Parameter "P": will be described later) falls in a range of from 8.0 to 18.5 at a treatment temperature falling in a range of from 150° C. to 600° C., thereby producing a titanium alloy whose tensile elastic limit strength is 950 MPa or more and elastic deformation capability is 1.6% or more.

The reasons are not necessarily definite why a titanium alloy with a high elastic deformation capability and high tensile elastic limit strength can be obtained by this production process, however, it is believed that the elastic anisotropy can be maintained and simultaneously the abrupt increment of the Young's modulus can be avoided by performing the aging treatment under the proper conditions after performing a predetermined magnitude of the cold working to the raw titanium alloy so that a titanium alloy with a high elastic deformation capability and high tensile elastic limit strength can be obtained.

② The raw titanium alloy can be produced, for example, in the following manner. Namely, it is suitable that said titanium alloy can be produced by a mixing step, in which at least two or more raw material powders including titanium and a Va group element are mixed, by a forming step, in which a mixture powder obtained after the mixing step is formed as a formed body with a predetermined shape, and by a sintering step, in which the formed body obtained after the forming step is sintered by heating. (Hereinafter, whenever appropriate, this production process will be abbreviated to as a "mixing method".)

③ Moreover, it is suitable that said raw titanium alloy can be produced by a filling step, in which a raw material powder including titanium and a Va group element is filled in a container with a predetermined shape, and by a sintering step, in which the raw material powder within the container is sintered by using a hot isostatic pressurizing method (HIP method) after the filling step. (Hereinafter, whenever appropriate, this production process will be abbreviated to as an "HIP method".)

The above-described production processes are preferable production processes for obtaining the titanium alloy according to the present invention. However, the present titanium alloy is not limited to those obtained by those production processes. For example, the raw titanium alloy can be produced by a melting method.

BEST MODE FOR CARRYING OUT THE INVENTION

A. Mode for Carrying Out

Hereinafter, while naming embodiment modes, the present invention will be described more specifically. Note that the contents of respective particulars, comprising material properties, alloy compositions, production steps and the like which are listed hereinafter, can be combined appropriately, and that it is not limited to exemplified combinations.

Titanium Alloy

(1) Elastic Deformation Capability, Tensile Elastic Limit Strength and Mean Young's Modulus An elastic deformation capability and a tensile elastic limit strength, which are concerned with a titanium alloy according the present invention, will be hereinafter described in detail by using FIGS. 1A and B.

Figure 1B:
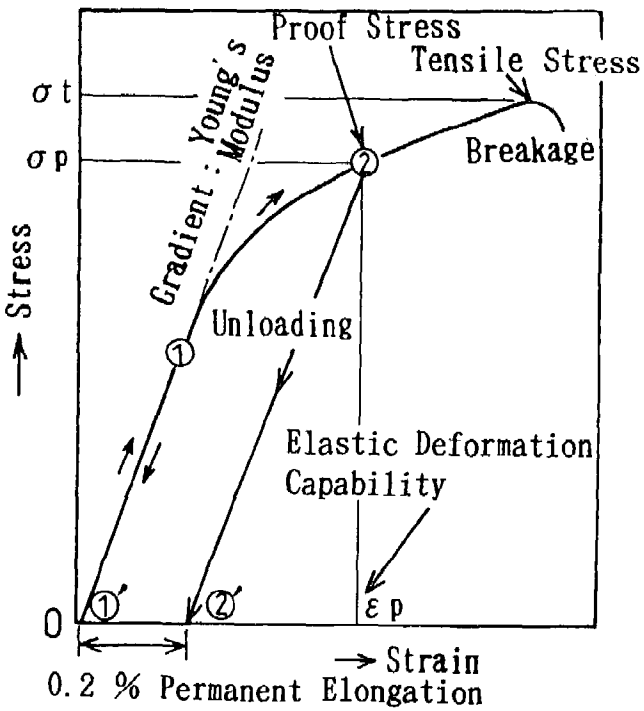
PRIOR ART FIG. 1(B)
FIG. 1B is a diagram for schematically illustrating a stress-strain chart of a conventional titanium alloy.
Figure 1A:
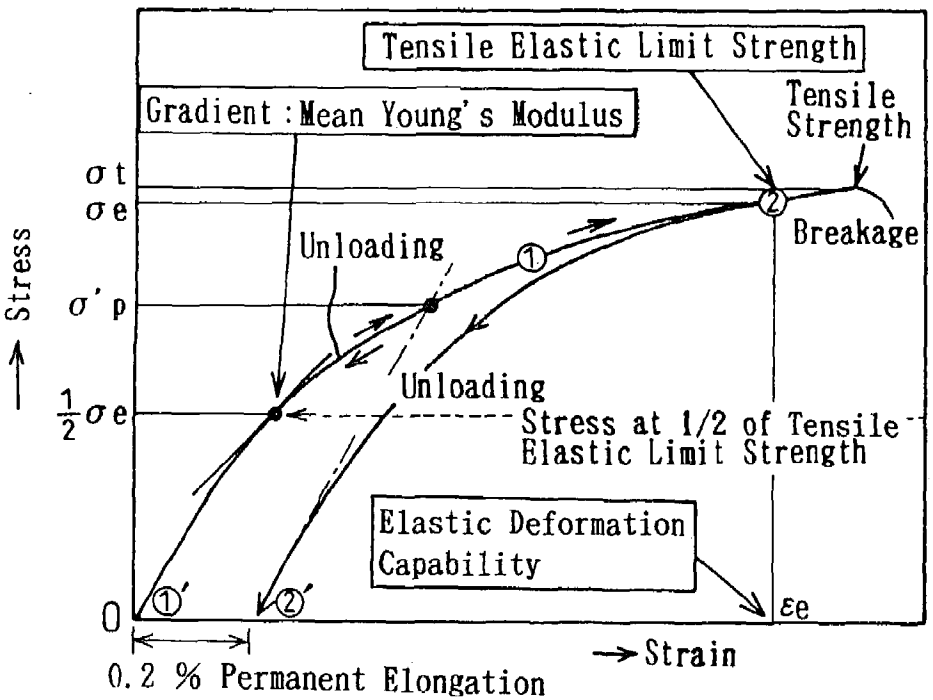
FIG. 1A is a diagram for schematically illustrating a stress-strain chart of a titanium alloy according to the present invention.

FIG. 1A is a drawing, which schematically illustrates a stress-strain diagram of the titanium according to the present invention, and FIG. 1B is a drawing, which schematically illustrates a stress-strain diagram of a conventional titanium alloy (Ti-6Al-4V alloy).

① As illustrated in FIG. 1B, in the conventional metallic material, the elongation increases linearly in proportion to the increment of the tensile stress (between ①'-①). Then, the Young's modulus of the conventional metallic material is found by the gradient of the straight line. In other words, the Young's modulus is a value, which is found by dividing a tensile stress (nominal stress) with a strain (nominal strain), which is in a proportional relationship thereto.

In the straight line range (between ①'-①), in which the stress and the strain are thus in a proportional relationship, the deformation is elastic, for example, when the stress is unloaded, the elongation, being the deformation of a test piece, returns to 0. However, when a tensile stress is further applied beyond the straight line range, the conventional metallic material starts deforming plastically, even when the stress is unloaded, the elongation of the test piece does not return to 0, and there arises a permanent elongation.

Ordinarily, a stress "σp," at which a permanent elongation becomes 0.2%, is referred to as a 0.2% proof stress (JIS Z 2241). This 0.2% proof stress is, on the stress-strain diagram, also a stress at the intersection (position ②) between a straight line (②'-②), which is obtained by parallelly moving the straight line (①'-①: the tangential line of the rising portion) in the elastic deformation range by a 0.2% elongation, and the stress-strain curve.

In the case of conventional metallic materials, ordinarily, it is believed that the 0.2% proof stress≈the tensile elastic limit strength based on the empirical rule "when the elongation exceeds by about 0.2%, it becomes the permanent elongation." Conversely, within the 0.2% proof stress, it is believed that the relationship between the stress and the strain is generally linear or elastic.

② However, as can be seen from the stress-strain diagram of FIG. 1A, such a conventional concept cannot be applied to a titanium alloy according to the present invention.

The reasons have not been clear, however, in the case of the present titanium alloy member, the stress-strain diagram does not become linear in the elastic deformation range, but it becomes an upwardly convexed curve (①'-②, when the stress is unloaded, the elongation returns to 0 along the same curve (①-①', or there arises a permanent elongation along ②-②'.

Thus, in the present titanium alloy, even in the elastic deformation range (①'-①), the stress and the strain are not in the linear relationship, when the stress increases, the elongation (strain) increases sharply. Moreover, it is the same in the case where the stress is unloaded, the stress and the strain are not in the linear relationship, when the stress decreases, the strain decreases sharply. These characteristics are believed to arise as the good high elastic deformation capability of the present titanium alloy.

By the way, in the case of the present titanium alloy, it is appreciated from FIG. 1A as well that the more the stress increases, the more the gradient of the tangential line on the stress-strain diagram decreases. Thus, in the elastic deformation range, since the stress and the strain do not change linearly, it is not appropriate to define the Young's modulus of the present titanium alloy in the same manner as conventionally. Moreover, it is not appropriate either to evaluate 0.2% proof stress (σp')≈tensile elastic limit strength by the same method as the conventional method. That is, in the case of the present titanium alloy, when the tensile elastic limit strength (≈0.2% proof stress) is found by the conventional method, it has become a remarkably smaller value than the inherent tensile elastic limit strength. Therefore, in the present titanium alloy, it is not possible anyway to define that 0.2% proof stress≈tensile elastic limit strength.

Hence, by turning back to the original definition of the tensile elastic limit strength, a tensile elastic limit strength (σe) of the present titanium alloy was found as described above (position ② in FIG. 1A), and the maximum elongation of the test specimen within the tensile elastic limit strength was made into the elastic deformation capability (εe)

③ Moreover, in the elastic deformation range, since the stress and the strain are not in a linear relationship, it is not preferable to apply the concept of the conventional Young's modulus to the present titanium alloy as it is. Hence, by introducing the concept of "mean Young's modulus," one of the properties of the present titanium alloy is indexed. Then, this mean Young's modulus was defined as a gradient (gradient of a tangential line to a curve) at a stress position which corresponded to ½ of the tensile elastic limit strength on the stress-strain curve obtained by the tensile test. Therefore, this mean Young's modulus does not indicate a "mean" value of Young's modulus in a strict sense.

Note that, in FIG. 1A and FIG. 1B, "σt" is the tensile strength, "εe" is the elongation (elastic deformation capability) at the tensile elastic limit strength (σe) of the present titanium alloy, and "εp" is the elongation (strain) at the 0.2% proof stress (σp) of the conventional metallic material.

④ Thus, since the present titanium alloy has an extraordinary stress-strain relationship which has not been available conventionally, in addition thereto, since it has a proper tensile elastic limit strength, a very good elastic deformation capability, namely, high elasticity can be obtained.

Based on this property, it is possible to grasp the present invention that it is a titanium alloy as well whose tensile elastic limit strength, defined as a stress when the permanent strain reaches 0.2% actually in the tensile test, is 950 MPa or more, which exhibits a property in which the gradient of the tangential line on the stress-strain diagram, obtained by the tensile test, decreases as the increment of the stress within the elastic deformation range in which the applied stress falls in a range of from 0 to the tensile elastic limit strength, whose mean Young's modulus, found by the gradient of the tangential line at the stress position corresponding to ½ of the tensile elastic limit strength as a representative value of the Young's modulus found from the gradient of the tangential line on the stress-strain curve, is 90 GPa or less, and which has such a high elastic deformation capability that the elastic deformation capability is 1.6% or more. Note that, when the mean Young's modulus lowers so that it is 85 GPa, 80 GPa, 75 GPa, 70 GPa, 65 GPa, 60 GPa, 55 GPa and 50 GPa, the present titanium alloy shows a much better elastic deformation capability.

Titanium Alloy

Descriptions on alloy compositions set forth hereinafter are not limited to the composition of the titanium alloy, but are common to the compositions of the raw titanium alloy and raw material powder. Hereinafter, description will made while taking the tiatnium alloy mainly as an example, but the contents (included elements, numerical ranges, reasons for limitation, and the like) are applicable to the raw titanium alloy and raw material powder as well. Moreover, the compositional ranges of elements are specified in a format of "from 'x' to 'y' %," this includes, unless otherwise specified in particular, the lower limit value "x" and upper limit value "y" (being the same hereinafter).

① It is suitable that, when the entirety is taken as 100% (percentage by mass: being the same hereinafter), the titanium alloy (raw titanium alloy or raw material powder, being the same hereinafter) according to the present invention can include a Va group element in an amount of from 30 to 60%.

When the Va group element is less than 30%, no sufficient elastic deformation capability can be obtained, moreover, when it exceeds 60%, no sufficient tensile elastic limit strength can be obtained so that the density of the titanium alloy rises to result in the decrement of specific strength. In addition, when it exceeds 60%, the segregation of materials is likely to arise, and the uniformity of materials is impaired, and accordingly it is not preferable because it is likely to result in the decrements of toughness and ductility as well.

The Va group element is either V, Nb or Ta, but it is not limited to the cases where one member of them is contained. Namely, it can be the case where two members or more of them are included, and Nb and Ta, Nb and V and Nb, Ta and V or Nb and Ta and V can be included in a proper amount each within the aforementioned range, respectively. In particular, it is good when Nb is from 10 to 45%, Ta is from 0 to 30% and V is from 0 to 7%.

② It is suitable that, when the entirety is taken as 100%, the present titanium alloy can include one or more elements selected from the metallic element group consisting of Zr, Hf and Sc in a summed amount of 20% or less.

When Sc is solved in titanium, it is an effective element which singularly decreases the bond energy between titanium atoms together with the Va group element to improve elastic deformation capability (namely, to lower Young's modulus) (Reference Paper: Proc. 9th World Conf. On Titanium (1999), to be published).

Zr and Hf are effective in improving the elastic deformation capability and tensile elastic limit strength of titanium alloy. Since these elements are homologous (IVa group) elements with titanium, and since they are completely-solving neutral elements, they do not hinder the high elastic deformation capability of titanium alloy resulting from the Va group element.

When these elements exceed 20% in total, it is not preferable because it results in the degradation of strength and toughness by the segregation of materials as well as in the rising cost.

In view of intending to balance among the elastic deformation capability (or mean Young's modulus), strength, toughness, and the like, it is further preferred that these elements are arranged to be 1% or more, furthermore from 5 to 15%. In particular, Zr can be from 1 to 15%, and Hf can be from 1 to 15%.

Further, the present titanium alloy can include one or more members of the IVa group elements (excepting Ti) and one more members of the Va group elements by arbitrarily combining them in the aforementioned respective ranges. For example, even when Zr and Nb, and one or more members of Ta or V are included simultaneously, the present titanium alloy can exhibit the high strength and the high elasticity without impairing the good cold working property.

③ Moreover, since Zr, Hf or Sc has many parts in common to the Va group elements operationally, they can substitute for the Va group elements within the predetermined ranges.

Namely, the present titanium alloy can include, when the entirety is taken as 100%, one or more elements selected from the metallic element group consisting of Zr, Hf and Sc in a summed amount of 20% or less, and said Va group element so that a summed amount of the Va group element and one or more elements among the metallic element group fall in a range of from 30 to 60%.

Zr and the like are arranged to be 20% or less in a summed amount as described above. Moreover, similarly, it is further preferred that these elements can be 1% or more, and can furthermore be from 5 to 15%, in a summed amount.

④ It is suitable that the present titanium alloy can include one or more elements selected from the metallic element group consisting of Cr, Mo, Mn, Fe, Co and Ni.

More specifically, it is suitable that, when the entirety is taken as 100%, Cr and Mo can be 20% or less, respectively, and Mn, Fe, Co and Ni can be 10% or less, respectively.

Cr and Mo are effective elements in improving the strength and hot forging property of titanium alloy. When the hot forging property is improved, it is possible to intend to improve the productivity and material yield of titanium alloy. Here, when Cr and Mo exceed 20%, the segregation of materials is likely to occur so that it is difficult to obtain homogeneous materials. When those elements are arranged to be 1% or more, it is possible to intend to improve strength by solid-solution strengthening, when it is arranged to be from 3 to 15%, it is further preferable.

Mn, Fe, Co and Ni are, similarly to Mo and the like, effective elements in improving the strength and hot forging property of titanium alloy. Therefore, instead of Mo, Cr and so forth, or together with Mo, Cr and so on, those elements can be contained as well. However, when those elements exceed 10%, it is not preferable because intermetallic compounds are formed between titanium and them so that ductility lowers. When those elements are arranged to be 1% or more, it is possible to intend to improve strength by solid-solution strengthening, and it is further preferable when they are arranged to be from 2 to 7%.

⑤ Furthermore, it is suitable to add tin (Sn) to the aforementioned metallic element group.

Namely, it is suitable that the present titanium alloy can include one or more elements selected from the metallic element group consisting of Cr, Mo, Mn, Fe, Co, Ni and Sn.

More specifically, when the entirety is taken as 100%, it is suitable that Cr and Mo can be 20% or less, respectively, and Mn, Fe, Co, Ni and Sn can be 10% or less, respectively.

Sn is an $\alpha$-stabilizing element, and is an effective element in improving the strength of titanium alloy. Therefore, it is good that 10% or less Sn can be contained together with an element such as Mo. When Sn exceeds 10%, the ductility of titanium alloy lowers so that it results in degrading workability. When Sn is arranged to be 1% or more, furthermore from 2 to 8%, it is further preferable in intending to make enhancing the elastic deformation capability and enhancing the tensile elastic limit strength compatible. Note that, regarding the element such as Mo, it is the same as described above.

⑥ It is suitable that the present titanium alloy can include Al.

Specifically, it is further suitable that, when the entirety is taken as 100%, Al can be from 0.3 to 5%.

Al is an effective element in improving the strength of titanium alloy. Therefore, it is good that the present titanium alloy can contain from 0.3 to 5% Al instead of Mo, Fe and the like, or together with those elements. When Al is less than 0.3%, the solid-solution strengthening action is insufficient so that no sufficient strength improvement can be intended. Moreover, when it exceeds 5%, the ductility of titanium alloy is degraded. When Al is arranged to be from 0.5 to 3%, it is further preferable because strength is stabilized.

Note that, when Al is added together with Sn, it is further preferable because it is possible to improve strength without degrading the toughness of titanium alloy.

⑦ It is suitable that, when the entirety is taken as 100%, the present titanium alloy can include from 0.08 to 0.6% O.

Moreover, when the entirety is taken as 100%, it is suitable that it can include from 0.05 to 1.0% C. In addition, when the entirety is taken as 100%, it is suitable that it can include from 0.05 to 0.8% N.

To summarize, when the entirety is taken as 100%, it is suitable that it can include at least one or more elements selected from the group of from 0.08 to 0.6% O, from 0.05 to 1.0% C and from 0.05 to 0.8% N.

O, C and N are all interstitial solid-solution strengthening elements, stabilize the α-phase of titanium alloy, and are effective elements in improving strength. When O is less than 0.08%, C or N is less than 0.05%, the strength of titanium alloy is not improved sufficiently. Moreover, when O exceeds 0.6%, C exceeds 1.0% or N exceeds 0.8%, it is not preferable because it results in embrittling titanium alloy.

When O is arranged to be 0.1% or more, furthermore from 0.15 to 0.45%, or when C is arranged to be from 0.1 to 0.8% and N is arranged to be from 0.1 to 0.6%, it is further preferable because it is possible to intend to balance between the strength and ductility of titanium alloy.

⑧ It is suitable that the present titanium alloy can include B in an amount of from 0.01 to 1.0% when the entirety is taken as 100%.

B is an effective element in view of improving the mechanical material characteristics and hot working property of titanium alloy. B hardly solves in titanium alloy, and almost all of the entire amount precipitates as titanium compound particles (TiB particles and the like). It is because the precipitated particles remarkably suppress the crystal granular growth of titanium alloy so that they maintain the structure of titanium alloy finely.

When B is less than 0.01%, the effect is not sufficient, when it exceeds 1.0%, it has resulted in the degradation of the elastic deformation capability and cold working property of titanium alloy by the increment of highly-rigid precipitated particles.

Note that, when the addition amount of B is converted into TiB particles, 0.01% B becomes 0.055% by volume TiB particles, and 1% B becomes 5.5% by volume TiB particles. Therefore, the present titanium alloy can be one which includes from 0.055% by volume to 5.5% by volume titanium boride particles.

By the way, the above-described respective compositional elements can be combined arbitrarily within the predetermined ranges. Specifically, said Zr, Hf, Sc, Cr, Mo, Mn, Fe, Co, Ni, Sn, Al, O, C, N and B can be appropriately combined within said ranges selectively to make the present titanium alloy. Of course, within such a range that does not deviate from the gist of the present titanium alloy, the other elements can be further compounded.

(3) Titanium Alloy Identified with Production Process

The above-described titanium alloy is such that the production process is not limited in particular, and can be produced by using the melting method or a sintering method described later.

Moreover, at the respective steps in the middle of the production, it is possible to adjust the material characteristics of the resulting titanium alloy by performing cold working, hot working, heat treatments, and the like. For example, it is preferred that the present titanium alloy can be the following ones.

Namely, it is suitable that the titanium alloy according to the present invention can be one which is produced by way of by way of a cold-working step, in which cold working of 10% or more is applied to a raw titanium alloy, comprising a Va group element and the balance of titanium substantially; and an aging treatment step, in which a cold-worked member, obtained after the cold-working step, is subjected to an aging treatment so that the Larson-Miller parameter "P" (hereinafter simply referred to as the parameter "P") falls in a range of from 8.0 to 18.5 at a treatment temperature falling in a range of from 150° C. to 600° C.

Moreover, the aging treatment step is suitable when a titanium alloy can be obtained in which the parameter "P" falls in a range of from 8.0 to 12.0 at said treatment temperature falling in a range of from 150° C. to 300° C.; and said tensile elastic limit strength is 1,000 MPa or more, and said elastic deformation capability is 2.0% or more.

In addition, the aging treatment step is suitable when a titanium alloy can be obtained in which the parameter "P" falls in a range of from 12.0 to 14.5 at said treatment temperature falling in a range of from 300° C. to 450° C.; and said tensile elastic limit strength is 1,400 MPa or more, and said elastic deformation capability is 1.6% or more.

The details of the cold working step and aging treatment step will be described later.

Production Process of Titanium Alloy

(1) Cold-Working Step

The cold-working step is an effective step in view of obtaining a titanium alloy which is of high elastic deformation capability and high tensile elastic limit strength.

According to the studies of the present inventors, it is believed that such cold working gives work strain in titanium alloy, and the work strain brings about micro structural change at atomic level in the texture to contribute to the improvement of the elastic deformation capability of titanium alloy. Moreover, by applying this cold working, micro structural change arises at atomic level. It is believed that the accumulation of elastic strain accompanied by this structural change contributes to the improvement of the tensile elastic limit strength of titanium alloy.

By the way, it is suitable that the cold working step can be such a step that a cold-working ratio is arranged to be 10% or more, and further, the cold-working ratio can be arranged to be 50% or more, 70% or more, 90% or more, 95% or more and 99% or more.

Then, the cold working step can be independently carried out as a pre-treatment of the aging treatment step, or can be carried out for the purpose of forming (for example, finish working) workpieces or products. Note that the cold working ratio is defined by the following equation:

$$\text{Cold-Working Ratio } X=(S_0-S)/S_0\times 100(\%)$$

wherein $S_0$: Cross-sectional Area before Cold Working, and S: Cross-sectional Area after Cold Working.

Moreover, "Cold" designates a low temperature which is sufficiently lower than a recrystallization temperature (a minimum temperature which causes recrystallization) of titanium alloy. Although the recrystallization temperature depends on compositions, it is 600° C. substantially, and, in the present production process, the cold working can be carried out in a range of from ordinary temperature to 300° C.

Thus, the titanium alloy according to the present invention is good in terms of the cold working property, and the material characteristics and mechanical characteristics tend to be improved by performing cold working. Therefore, the titanium alloy according to the present invention is a material suitable for cold-worked products. Moreover, the present production process is a production process suitable for cold-worked products.

(2) Aging Treatment Step

The aging treatment step is a step in which an aging treatment is performed onto the cold-worked member. The present inventors newly discovered that a titanium alloy which is of high elastic deformation capability and high tensile elastic limit strength can be obtained by performing the aging treatment step.

However, it is not preferable to carry out a solution treatment at a recrystallizing temperature or more before performing the aging treatment step, because the influence of working strain, which has been given within titanium alloy by cold working, is lost.

In the aging treatment condition, there are (a) a low-temperature short-time aging treatment (from 150 to 300° C.) and (b) a high-temperature long-time aging treatment (from 300 to 600° C.)

In the former case, while improving the tensile elastic limit strength, it is possible to maintain or lower the mean Young's modulus. As a result, it is possible to obtain a titanium alloy which is of high elastic deformation capability. In the latter case, accompanied by the rising the tensile elastic limit strength, the mean Young's modulus can rise more or less, but the mean Young's modulus is nevertheless 95 GPa or less, and the rising level is very low. Therefore, even in this case, a titanium alloy can be obtained which is of high elastic deformation capability.

Moreover, the present inventors found out by repeating an enormous number of experiments that it is preferred that, at a treatment temperature falling in a range of from 150 to 600° C., the aging treatment step can be a step in which a parameter (P), which is determined with a treatment temperature ("T" ° C.) and a treatment time ("t" hours) based on the following equation, falls in a range of from 8.0 to 18.5.

$$P=(T+273)\cdot(20+\log_{10}t)/1000$$

This parameter "P" is a Larson-Miller parameter, is determined by a combination of a heat treatment temperature and a heat treatment time, and indexes the conditions of the aging treatment (heat treatment) of the present invention.

When the parameter "P" is less than 8.0, even if the aging treatment is performed, no favorable improvements on the material characteristics can be obtained, when the parameter "P" exceeds 18.5, it could result in the lowering of the tensile elastic limit strength, the rising of the mean Young's modulus or the lowering of the elastic deformation capability.

Moreover, it is suitable that the aging treatment step can be such that the parameter "P" falls in a range of from 8.0 to 12.0 at said treatment temperature falling in a range of from 150° C. to 300° C.; and the tensile elastic limit strength of the resulting titanium alloy is 1,000 MPa or more, the elastic deformation capability is 2.0% or more, and the mean Young's modulus is 75 GPa or less.

In addition, it is suitable that the aging treatment step can be such that the parameter "P" falls in a range of from 12.0 to 14.5 at said treatment temperature falling in a range of from 300° C. to 450° C.; and the tensile elastic limit strength of said titanium alloy is 1,400 MPa or more, the elastic deformation capability is 1.6% or more, and the mean Young's modulus is 95 GPa or less.

By selecting a treatment temperature and a treatment time which make the parameter "P" fall in a more appropriate range, a titanium alloy can be obtained which is further of high elastic deformation capability and high tensile elastic limit strength.

Note that, unless otherwise specified in particular, a numerical range such as "from 'x' to 'y,'" includes the lower limit value "x" and upper limit value "y" (being the same hereinafter)

(3) Raw Material Powder

When the mixing method according to the present invention is employed, a raw material powder is needed which includes titanium and a Va group element at least. Depending on the compositions and characteristics of desired titanium alloys, it is possible to use raw material powders which contain a variety of the above-described elements.

As described above, it is suitable that the raw material powder can include, in addition to the titanium and Va group element, at least one or more elements selected from the group consisting of Zr, Hf, Sc or Cr, Mn, Co, Ni, Mo, Fe, Sn, Al, O, C, N and B.

Such a raw material powder can be either pure metallic powders or alloy powders. For the raw material powder, for example, sponge powders, hydrogenated dehydrogenated powders, hydrogenated powders, atomized powders and the like can be used. The particulate shapes, particle diameters (particle diameter distributions) and so forth of the powders are not limited in particular, and commercially available powders can be used as they are.

Indeed, it is preferred that, from the viewpoint of the costs and denseness of sintered bodies, the raw material powder can be such that the average particle diameter is 100 μm or less. Moreover, when the particle diameters of powders are 45 μm (#325) or less, it is likely to obtain much denser sintered bodies.

② In the case of using the HIP method according to the present invention, a mixture powder comprising elementary powders can be utilized in the same manner as the mixing method, but an alloy powder itself, having a desired alloy composition, can be utilized as the raw material powder.

Then, the raw material powder having a composition of a titanium alloy according to the present invention can be produced, for example, by a gas atomizing method, an REP method (rotary electrode method) and an PREP method (plasma rotary electrode method), or by hydrogen pulverizing ingots produced by melting processes, and by an MA method (mechanical alloying method), and the like.

(4) Mixing Step

The mixing step is a step in which the raw material powder is mixed. By this mixing step, the raw material powder is mixed uniformly, and macroscopically uniform titanium alloys are obtained.

In mixing the raw material powder, a type "V" mixer, a ball mill and a vibration mill, a high-energy ball mill (for example, an attritor) and the like can be used.

(5) Forming Step

The forming step is a step in which the mixture powder obtained after the mixing step is formed into a formed body with a predetermined shape. Since a formed body with a predetermined shape is obtained, the reduction of the subsequent processing man-hour requirements is intended.

Note that the formed body can be formed as workpiece shapes, such as plate materials and rod materials, as shapes of final products, or as shapes of intermediate products before arriving at them. Moreover, in the case of further performing processing after the sintering step, it can be formed as billet shapes, and the like.

For the forming step, mold forming, CIP forming (cold isostatic pressure press forming), RIP forming (rubber isostatic pressure press forming), and the like, can be used, for example. In particular, in the case of carrying out CIP forming, it is good that the forming pressure can be arranged to fall in a range of from 200 to 400 MPa, for instance.

(6) Filling Step

The filling step is a step in which the above-described raw material powder is filled in a container with a predetermined shape, and is needed in order to use the hot isostatic pressurizing method (HIP method). It is good that the inside shape of the container can be corresponded to desired product shapes. Moreover, the container can be made of metal, can be made of ceramic, or can be made of glass. In addition, after vacuuming and degassing, the raw material can be filled and sealed in the container.

(5) Sintering Step

The sintering step is a step in which the formed body after said forming step is heated to sinter, or the raw material powder in the container after the filling step is sintered by a hot hydrostatic pressure method.

Since the treatment temperature (sintering temperature) in this instance is extremely lower than the melting point of titanium alloy, in accordance with the production process of the present invention, it is possible to economically produce the titanium alloy without requiring special apparatuses like the melting method.

① In the case of the mixing method, it is preferable to sinter the formed body in vacuum or in an inert gas atmosphere. Moreover, it is preferred that the treatment temperature can be the melting temperature of alloy or less, and that it can be carried out in a temperature range where the respective component elements diffuse sufficiently. For example, it is preferable to control the treatment temperature from 1,200° C. to 1,600° C.

Moreover, in view of intending to densify the titanium alloy and to make the productivity more efficient, it is further suitable to control the treatment temperature from 1,200° C. to 1,600° C. and to control the treatment time from 0.5 to 16 hours.

② In the case of the HIP method, it is preferred that it can be carried out in a temperature range where it is easy to diffuse, the deformation resistance of the raw material powder is less, and it is less like to react with the container. For example, it is good to control the temperature range from 900° C. to 1,300° C. Moreover, it is preferred that the forming pressure can be a pressure at which the filled powder can fully undergo creep deformation, for example, it is good to control the pressure range from 50 to 200 MPa (500 to 2,000 atm).

The HIP treatment time can preferably be times in which the raw material powder fully undergoes creep deformation to densify and the alloying components can diffuse between powders. For example, it is good that the time can be controlled from 1 hour to 10 hours.

Moreover, in the case of the HIP method, the mixing step and forming step, which are needed in the mixing method, are not necessarily required, and the so-called alloy powder method is made possible. Therefore, in this case, as described above, the types of usable raw material powders are expanded, and it is possible to use not only mixture powders, in which two or more types of pure metal powders or alloy powders are mixed, but also alloy powders having desired alloy compositions themselves as the raw material powder. Moreover, when the HIP method is used, it is possible to obtain densely sintered titanium alloys, and, even if product shapes are complicated, it is possible to make net shapes.

(6) Hot Working Step

The hot working step is, in the mixing method, a step in which the texture of the sintered body after the sintering step is densified. There are many pores and the like in the sintered body when it is as sintered after the sintering step. By performing the hot working step, it is possible to reduce the pores and so forth and to make it into a dense sintered body. Then, by carrying out the hot working step, it is possible to intend to improve the tensile elastic limit strength of titanium alloy. Therefore, it is further suitable that said raw titanium alloy can be produced via the hot working step in which hot working is applied to the sintered body obtained after said sintering step.

The hot working means plastic working at recrystallization temperature or more, for example, there are hot forging, hot rolling, hot swaging, hot coining, and the like. It is suitable that the hot working step can be a step in which the working temperature is controlled from 600 to 1,100° C. This temperature is the temperature of the sintered body itself to be worked. At less than 600° C., deformation resistance is high, the hot working step is difficult so that it results in lowering the material yield. On the other hand, when the hot working step is carried out beyond 1,100° C., the crystalline particles are coarsened so that it is not preferable.

By this hot working step, it is also possible to roughly form the shapes of products. Moreover, by adjusting the pore volume in the texture of the sintered body, it is possible as well to adjust the Young's modulus, strength, density and the like of titanium alloy.

(Usage of Titanium Alloy)

Since the present titanium alloy exhibits a high elasticity and a high strength, it can be utilized extensively in products which match the characteristics. Moreover, since it is provided with a good cold working property, it is suitable to utilize the present titanium alloy in cold-worked products. This is because it is possible to intend the material yield improvement by remarkably reducing work cracks and the like without the intervention of intermediate annealing and so forth.

When cold forming and the like are carried out onto conventional products, which are believed to require machining and the like in view of the shapes, by using the present titanium alloy, it is likely to intend to mass-produce the titanium products and lower the costs. Then, the present production process is effective in the circumstances.

When specific examples are named in which the present titanium alloy can be utilized, there are industrial machines, automobiles, motorbikes, bicycles, household electric appliances, aero and space apparatuses, ships, accessories, sports and leisure articles, products relating to living bodies, medical equipment parts, toys, and the like.

For example, when the present titanium alloy is used in an automotive (coiled) spring, due to the high elastic deformation capability (low Young's modulus), it is possible to sharply lower the number of turns compared with springs made of conventional spring steels. Moreover, in addition to the reduction of the number of turns, since the present titanium alloy exhibits a Young's modulus by about 70% of conventional spring steels, it is possible to realize remarkable light-weighting.

Further, when the present titanium alloy is used in a frame of eyeglasses, being one of accessories, because of the high elastic deformation capability, the temples, etc., are likely to bend so that it fits well with a face. Further, the eyeglasses make ones which are good in terms of the impact absorbing property and the recovering property of the shapes. Furthermore, since it is good in terms of the cold-working property, it is easy to form it from fine line materials to frames of eyeglasses, and the like, and can be intended to improve the material yield.

Furthermore, when the present titanium alloy is used in a golf club, being one of sports and leisure articles, the shaft is likely to flex, an elastic energy to be transmitted to a golf ball increases, and it is possible to expect to improve the driving distance of the golf ball.

Moreover, when a head of a golf club, especially, a face part comprises the present titanium alloy, the intrinsic frequency of the head can be sharply reduced by the high elastic deformation ability (low Young's modulus) and by the thinning resulting from the high tensile elastic limit strength. Therefore, the golf club provided with the head comes to greatly extend the driving distance of the golf ball. Note that the theories regarding golf clubs are disclosed, for example, in Japanese Examined Patent Publication (KOKOKU) No. 7-98,077, International Laid-Open Publication No. WO98/46,312, and the like. In addition, when the present titanium alloy is used in golf clubs, it is possible to improve the hit feeling and so forth of golf clubs, and the degree of freedom can be remarkably expanded in designing golf clubs.

In addition, in the field of medical treatments, the present titanium alloy can be used in artificial bones, artificial joints, artificial transplantation tissues, fasteners for bones, and the like, which are disposed in a living body, and in functional members (catheters, forcepses, valves, etc.) and so forth of medical instruments. For example, when an artificial bone comprises the present titanium alloy, the artificial bone has an elastic deformation capability, which is close to those of human bones, the balance can be intended to keep up with human bones so that it is good in terms of the living body compatibility, and, in addition, it has a sufficiently high tensile elastic limit strength as bones.

Still further, the present titanium alloy is suitable for damping members. This is because, as it is understood from the relational equation, $E=\rho V^2$ (E: Young's modulus, ρ: Material Density, V: Acoustic Velocity Transmitted in the Material), that the acoustic velocity, which is transmitted in the material, can be reduced by lowering the Young's modulus (improving the elastic deformation capability).

In addition, the present titanium alloy can be used in a variety of respective products in a variety of fields, for example, raw materials (wires, rods, square bars, plates, foils, fibers, fabrics, etc.), portable articles (clocks (wristwatches), barrettes (hair accessories), necklaces, bracelets, earrings, pierces, rings, tiepins, brooches, cuff links, belts with buckles, lighters, nibs of fountain pens, clips for fountain pens, key rings, keys, ballpoint pens, mechanical pencils, etc.), portable information terminals (cellular phones, portable recorders, cases, etc., of mobile personal computers, etc., and the like), springs for engine valves, suspension springs, bumpers, gaskets, diaphragms, bellows, hoses, hose bands, tweezers, fishing rods, fishhooks, sewing needles, sewing-machine needles, syringe needles, spikes, metallic brushes, chairs, sofas, beds, clutches, bats, a variety of wires, a variety of binders, clips for papers, etc., cushioning materials, a variety of metallic sheets, expanders, trampolines, a variety of physical fitness exercise apparatuses, wheelchairs, nursing apparatuses, rehabilitation apparatuses, brassieres, corsets, camera bodies, shutter component parts, blackout curtains, curtains, blinds, balloons, airships, tents, a variety of membranes, helmets, fishing nets, tea strainers, umbrellas, firemen's garments, bullet-proof vests, a variety of containers, such as fuel tanks, inner linings of tires, reinforcement members of tires, chassis of bicycles, bolts, rulers, a variety of torsion bars, spiral springs, power transmission belts (hoops, etc., of CVT), and so forth.

Note that the present titanium alloy and the products can be produced not only by the above-described present production processes but also by a variety of production processes, such as casting, forging, super plastic forming, hot working, cold working, sintering and HIP.

B. EXAMPLES

Hereinafter, the present invention will be described more specifically while naming a variety of examples concerning the present titanium alloy and the production processes.

Production of Samples

The titanium alloys of Example Nos. 1 through 4 (Sample Nos. 1 through 19) had, as set forth in Table 1, from 30 to 60% Va group elements and Ti as the components, were subjected to the cold working step and aging treatment step, and were produced in the following manner.

① As raw materials, a commercially available hydrogenated-and-dehydrogenated Ti powder (-#325, -#100), and a niobium (Nb) powder (-#325), a vanadium (V) powder (-#325) and a tantalum (Ta) powder (-#325) were prepared. These respective powders were compounded so as to make the composition proportions of Table 1, and were mixed by using an attritor or a ball mill (a mixing step). Note that the unit of the alloy compositions set forth Table 1 is percentage (%) by mass, and the balance is titanium.

② These mixture powders were formed by CIP (cold hydrostatic pressure forming) at a pressure of 400 MPa, and thereby cylinder-shaped formed bodies of ϕ40×80 mm were obtained (a forming step).

③ The formed bodies obtained after the forming step were sintered under the treatment temperatures and treatment times set forth in Table 1 (sintering-step conditions) in vacuum of $5\times10^{-3}$ Pa, and thereby sintered bodies were obtained (a sintering step)

④ These sintered bodies were hot forged in air of from 700 to 1,150° C., and were thereby made into round bars of ϕ15 mm (a hot forging step).

To these, cold swaging processing with cold working ratios set forth in Table 1 was performed, and thereby cold-worked members (sample members) were obtained (a cold working step).

Moreover, to these cold-worked members, aging treatments were performed within a heating furnace in an Ar gas atmosphere (an aging treatment step).

Explanation on Every Example

Next, specific production conditions for each of the examples or each of the samples will be explained.

(1) Example No. 1

Sample Nos. 1 Through 7

The present example is one in which, as set forth in Table 1, a 1,300° C.×16-hour sintering step was performed onto a formed body comprising a mixture powder having a composition of Ti-30Nb-10Ta-5Zr (% s are omitted: being the same hereinafter) to make a sintered body, the aforementioned hot working step and a cold working step with 87%-cold working ratio were performed onto this sintered body, and thereafter an aging treatment step was applied to the obtained cold-worked substance under a variety of conditions as set forth in Table 1.

(2) Example No. 2

Sample Nos. 8 Through 10

The present example is one in which a sintering step and a cold working step were performed onto the alloy having the same composition as that of Example No. 1 under different conditions as set forth in Table 1, and thereafter an aging treatment step was applied to the respective samples under the same conditions.

(3) Example No. 3

Sample Nos. 11 Through 17

The present example is one in which sintering steps and cold working steps were performed onto alloys having different compositions as set forth in Table 1 under different conditions as set forth in Table 1, and thereafter an aging treatment step was applied to the samples under different conditions for each of the samples.

(4) Example No. 4

Sample Nos. 18 and 19

The present example is one in which, with respect to the respective samples of Example No. 1 or Example No. 2, theoxygen contents were varied as set forth in Table 1. The conditions of the sintering step, cold working step and aging treatment step were substantially identical with those of Example No. 1 or Example No. 2.

From the results of this Example No. 4, it is understood that oxygen is an effective element in order to achieve a low Young's modulus and a high strength (high elasticity).

(5) Comparative Examples

Sample Nos. C1 Through C4

As comparative examples, Sample Nos. C1 through C4 were produced which comprised compositions and process conditions as set forth in Table 1.

Sample No. C1 is one in which a hot-worked member was used as it was and no cold working step and aging treatment step were applied thereto.

Sample No. C2 is one in which no cold working was performed onto a hot-worked member and an aging treatment step whose parameter "P" value was low was applied thereto.

Sample No. C3 is one in which an aging treatment step whose parameter "P" value was high was applied to a cold-worked member.

Sample No. C4 is one in which an aging treatment step was applied to an ingot which was produced by a melting method and whose Va group element was less than 30%.

Measurements of Material Characteristics

The material characteristics of the above-described respective samples were determined by the methods set forth below.

On the respective samples, a tensile test was carried out by using an Instron testing machine, the loads and the elongations were measured, and the stress-strain curves were determined. The Instron testing machine was a universal tensile testing machine, which was made by Instron (a name of a maker), and its driving system was an electric-motor control system. The elongations were measured by outputs of a strain gage, which was bonded on a side surface of the test pieces.

The tensile elastic limit strength and the tensile strength were determined by the above-described methods based on the stress-strain curves. The elastic deformation capabilities were determined by finding elongations, which corresponded to the tensile elastic limit strengths, from the stress-strain curves.

The mean Young's modulus was, as described above, determined as gradients (gradients of tangents of curves) at stress positions which corresponded to ½ of the tensile elastic limit strengths which were obtained based on the stress-strain curves. The elongations were elongations at breakage which were found from the stress-strain curves.

These measurement results, determined on the above-described respective samples, are set forth in Table 1 altogether.

TABLE 1

| | Sample No. | Alloy Composition (% by mass) | Sintering Condition Temp. (° C.) | Sintering Condition Time (hr) | Cold Working Ratio (%) | Aging Treatment Condition Temp. (° C.) | Aging Treatment Condition Time (hr) | Parameter "P" | Mean Young's Modulus (GPa) | Tensile Elastic Limit Strength (MPa) | Elastic Deformation Capability (%) | Tensile Strength (MPa) | Elongation (%) | Remarks |
|---|---|---|---|---|---|---|---|---|---|---|---|---|---|---|
| Ex. No. 1 | 1 | Ti—30Nb—10Ta—5Zr | 1,300 | 16 | 87 | 150 | 1 | 8.5 | 51 | 1,034 | 2.0 | 1,077 | 11 | Oxygen Content, 0.25% |
| | 2 | ↑ | ↑ | ↑ | ↑ | 200 | 0.5 | 9.3 | 49 | 1,047 | 2.1 | 1,085 | 12 | Oxygen Content, 0.27% |
| | 3 | ↑ | ↑ | ↑ | ↑ | 250 | 12 | 11.0 | 50 | 1,020 | 2.0 | 1,063 | 13 | Oxygen Content, 0.23% |
| | 4 | ↑ | ↑ | ↑ | ↑ | 300 | 1 | 11.5 | 50 | 1,083 | 2.2 | 1,128 | 9 | Oxygen Content, 0.26% |
| | 5 | ↑ | ↑ | ↑ | ↑ | ↑ | 24 | 12.3 | 87 | 1,476 | 1.7 | 1,529 | 4 | Oxygen Content, 0.22% |
| | 6 | ↑ | ↑ | ↑ | ↑ | 400 | ↑ | 14.4 | 86 | 1,483 | 1.7 | 1,540 | 7 | Oxygen Content, 0.25% |
| | 7 | ↑ | ↑ | ↑ | ↑ | 500 | 1 | 15.5 | 62 | 969 | 1.6 | 999 | 13 | Oxygen Content, 0.23% |
| Ex. No. 2 | 8 | Ti—30Nb—10Ta—5Zr | 1,300 | 4 | 80 | 350 | 12 | 13.1 | 85 | 1,458 | 1.7 | 1,502 | 4 | Oxygen Content, 0.22% |
| | 9 | ↑ | 1,260 | 8 | 95 | ↑ | ↑ | 13.1 | 85 | 1,481 | 1.7 | 1,541 | 4 | Oxygen Content, 0.27% |
| | 10 | ↑ | ↑ | 2 | ↑ | ↑ | ↑ | 13.1 | 79 | 1,477 | 1.8 | 1,507 | 3 | Oxygen Content, 0.23% |
| Ex. No. 3 | 11 | Ti—23Nb—4Ta—18Zr—5V | 1,300 | 8 | 91 | 550 | 2 | 16.7 | 67 | 1,164 | 1.7 | 1,210 | 9 | Oxygen Content, 0.27% |
| | 12 | Ti—25Nb—6Ta—2Zr—3V—3Hf | 1,450 | 4 | ↑ | 400 | 12 | 14.2 | 81 | 1,421 | 1.8 | 1,487 | 5 | Oxygen Content, 0.30% |
| | 13 | Ti—30Nb—4Ta—10Zr—6V | 1,400 | 2 | ↑ | 250 | 0.5 | 10.3 | 56 | 1,013 | 1.8 | 1,094 | 11 | Oxygen Content, 0.29% |
| | 14 | Ti—12Nb—30Ta—7Zr—2V | 1,300 | 16 | ↑ | 400 | 24 | 14.4 | 80 | 1,720 | 2.1 | 1,795 | 5 | Oxygen Content, 0.31% |
| | 15 | Ti—37Nb—3Ta—3Zr | 1,300 | 4 | 87 | ↑ | 1 | 10.5 | 51 | 1,081 | 2.1 | 1,124 | 9 | Oxygen Content, 0.23% |
| | 16 | Ti—35Nb—3Ta—9Zr | ↑ | 4 | ↑ | 350 | 12 | 13.1 | 82 | 1,441 | 1.8 | 1,501 | 5 | Oxygen Content, 0.22% |
| | 17 | Ti—35Nb—9Zr | ↑ | 4 | ↑ | ↑ | ↑ | 13.1 | 85 | 1,505 | 1.8 | 1,555 | 4 | Oxygen Content, 0.25% |
| Ex. No. 4 | 18 | Ti—30Nb—10Ta—5Zr | 1,300 | 16 | 91 | 350 | 12 | 13.1 | 86 | 1,552 | 1.8 | 1,593 | 7 | Oxygen Content, 0.41% |
| | 19 | ↑ | ↑ | ↑ | ↑ | ↑ | ↑ | ↑ | 88 | 1,573 | 1.8 | 1,610 | 5 | Oxygen Content, 0.55% |
| Comp. Ex. | C1 | Ti—30Nb—10Ta—5Zr | 1,300 | 16 | — | — | — | — | 66 | 754 | 1.1 | 785 | 17 | W/O Age Treatment |
| | C2 | ↑ | ↑ | ↑ | — | 50 | 4 | 6.7 | 68 | 769 | 1.1 | 793 | 17 | Member, Low-"P" Value Treatment |
| | C3 | Ti—30Nb—10Ta—5Zr | ↑ | ↑ | 87 | 900 | 1 | 23.5 | 65 | 872 | 1.3 | 913 | 19 | Member, High-"P" Value Treatment |
| | C4 | Ti—13Nb—13Zr | — | — | — | 450 | 4 | 14.9 | 81 | 864 | 1.1 | 994 | 18 | Member, Another Composition |

Assessment

① Tensile Elastic Limit Strength or Tensile Strength

Comparing the examples with the comparative examples, it is understood that the tensile elastic limit strengths or tensile strengths were increased by about from 250 to 800 MPa by performing appropriate cold working and aging treatment.

② Mean Young's Modulus or Elastic Deformation Capability

Although the mean Young's modulus was such that there were cases accompanied by some increments by applying the aging treatments, the mean Young's modulus was 90 GPa or less in all of the cases, and it is understood that it is possible to control the Young's modulus by properly selecting the aging treatment conditions.

Moreover, the elastic deformation capability of such large values as 1.6% or more was exhibited by improving the strength and controlling the mean Young's modulus, and it was possible to verify that a titanium alloy can be obtained which is of high elastic deformation capability and high tensile elastic limit strength.

Thus, the present titanium alloy which is of high elastic deformation capability and has a high tensile elastic limit strength can be used extensively in a variety of products, moreover, since it is good in terms of the cold working property, the improvement of their productivities can be intended as well. Then, in accordance with the present production processes for producing the present titanium alloy, it is possible to obtain such a titanium alloy with ease.

The invention claimed is:

1. A titanium alloy having a high elastic deformation capability, comprising a Va group (vanadium group) element in an amount of from 30 to 60%, and the balance of titanium substantially, when the entirety is taken as 100% (percentage by mass: being the same hereinafter), wherein the titanium alloy is obtained by subjecting a cold-worked member, to which a work strain is given by a cold-working step, to an aging treatment so that the Larson-Miller parameter "P" (hereinafter simply referred to as the parameter "P") falls in a range of from 8.0 to 18.5 at a treatment temperature falling in a range of from 150° C. to 600° C.; and the titanium alloy has a tensile elastic limit strength of 950 MPa or more and an elastic deformation capability of 1.6% or more.

2. The titanium alloy set forth in claim 1 comprising one or more elements selected from the metallic element group consisting of zirconium (Zr), hafnium (Hf) and scandium (Sc) in a summed amount of 20% or less when the entirety is taken as 100%.

3. The titanium alloy set forth in claim 1 comprising one or more elements selected from the metallic element group consisting of chromium (Cr), molybdenum (Mo), manganese (Mn), iron (Fe), cobalt (Co) and nickel (Ni), wherein the Cr and Mo are 20% or less, respectively, and the Mn, Fe, Co and Ni are 10% or less, respectively, when the entirety is taken as 100%.

4. The titanium alloy set forth in claim 1, further comprising from 0.3 to 5% aluminum (Al) when the entirety is taken as 100%.

5. The titanium alloy set forth in claim 1 comprising from 0.08 to 0.6% oxygen (0) when the entirety is taken as 100%.

6. The titanium alloy set forth in claim 1 comprising from 0.05 to 1.0% carbon (C) when the entirety is taken as 100%.

7. The titanium alloy set forth in claim 1 comprising from 0.05 to 0.8% nitrogen (N) when the entirety is taken as 100%.

8. The titanium alloy set forth claim 1, further comprising from 0.01 to 1.0% boron (B) when the entirety is taken as 100%.

9. The titanium alloy set forth in claim 1, wherein in the cold-working step a cold working of 10% or more is applied to a raw titanium alloy comprising a Va group element in an amount of from 30 to 60% and the balance of titanium substantially.

10. The titanium alloy set forth in claim 9, wherein.

in the aging treatment the parameter "P" falls in a range of from 8.0 to 12.0 and the treatment temperature falls in a range of from 150° C. to 300° C.; and the titanium alloy has a tensile elastic limit strength of 1,000 MPa or more, an elastic deformation capability is 2.0% or more, and a mean Young's modulus of 75 GPa or less.

11. The titanium alloy set forth in claim 9, wherein in the aging treatment the parameter "P" falls in a range of from 12.0 to 14.5 and the treatment temperature falls in a range of from 300° C. to 450° C.; and the titanium alloy has a tensile elastic limit strength of 1,400 MPa or more, and a mean Young's modulus is 95 GPa or less.

12. The titanium alloy set forth in claim 1, wherein, within an elastic deformation range where an applied stress falls in a range of from 0 to a tensile elastic limit strength defined by a stress at which a permanent strain truly reaches 0.2% in a tensile test, the cold-worked member shows such a characteristic that a gradient of a tangent on a stress-strain curve obtained by the tensile test decreases as the stress enlarges.

13. A process for producing a titanium alloy having a high elastic deformation capability comprising:

a cold-working step, in which cold working of 10% or more is applied to a raw titanium alloy, comprising a Va group element in an amount of from 30 to 60% by weight and the balance of titanium substantially when the entirety is taken as 100%; and an aging treatment step in which a cold-worked member, obtained after the cold-working step, is subjected to an aging treatment so that the Larson-Miller parameter "P," (hereinafter simply referred to as the parameter "P") falls in a range of from 8.0 to 18.5 at a treatment temperature falling in a range of from 150° C. to 600° C., thereby being able to produce a titanium alloy whose tensile elastic limit strength is 950 MPa or more and elastic deformation capability is 1.6% or more.

14. The process for producing a titanium alloy set forth in claim 13, wherein the parameter "P" falls in a range of from 8.0 to 12.0 and the treatment temperature falls in a range of from 150° C. to 300° C.; and the titanium alloy has a tensile elastic limit strength of 1,000 MPa or more, an elastic deformation capability of 2.0% or more, and a mean Young's modulus of 75 GPa or less.

15. The process for producing a titanium alloy set forth in claim 13, wherein the parameter "P" falls in a range of from 12.0 to 14.5 and the treatment temperature falls in a range of from 300° C. to 450° C.; and the titanium alloy has a tensile elastic limit strength of 1,400 MPa or more, and a mean Young's modulus of 95 GPa or less.

16. The process for producing a titanium alloy set forth in claim 13, wherein the raw titanium alloy is produced by a mixing step, in which at least two material powders including titanium and a Va group element are mixed;

a forming step in which a mixture powder obtained after the mixing step is formed as a formed body with a predetermined shape; and a sintering step in which the formed body obtained after the forming step is sintered by heating.

17. The process for producing a titanium alloy set forth in claim 16, wherein the sintering step is a step in which a treatment temperature falls in a range of from 1,200° C. to 1,600° C. and a treatment time falls in a range of from 0.5 to 16 hours.

18. The process for producing a titanium alloy set forth in claim 16, wherein the raw titanium alloy is produced by way of a hot-working step in which hot working is further applied to a sintered body obtained after the sintering step.

19. The process for producing a titanium alloy set forth in claim 18, wherein the hot-working step is a step in which a working temperature falls in a range of from 600° C. to 1,100° C.

20. The process for producing a titanium alloy set forth in claim 19, wherein the raw titanium alloy is produced by a filling step in which a raw material powder including titanium and a Va group element is filled in a container with a predetermined shape, and a sintering step in which the raw material powder within the container is sintered by using a hot isostatic Pressurizing method (HIP method) after the filling step.

* * * * *

UNITED STATES PATENT AND TRADEMARK OFFICE

CERTIFICATE OF CORRECTION

PATENT NO. : 7,261,782 B2
APPLICATION NO. : 10/450530
DATED : August 28, 2007
INVENTOR(S) : JungHwan Hwang et al.

It is certified that error appears in the above-identified patent and that said Letters Patent is hereby corrected as shown below:

Column 26, line 15, "the container is sintered by using a hot isostatic Pres-"
should read -- the container is sintered by using a hot isostatic pres- --

Signed and Sealed this

Fifteenth Day of April, 2008

JON W. DUDAS
*Director of the United States Patent and Trademark Office*